US005383794A

United States Patent [19]

Davis et al.

[11] Patent Number: 5,383,794

[45] Date of Patent: Jan. 24, 1995

[54] LATCH ACTUATOR FOR A CONNECTOR

[75] Inventors: Wayne S. Davis, Harrisburg; Michael E. Shirk, Grantville; Earl C. Myers, Jr., Harrisburg, all of Pa.

[73] Assignee: The Whitaker Corporation, Wilmington, Del.

[21] Appl. No.: 93,543

[22] Filed: Jul. 16, 1993

[51] Int. Cl.[6] ..... H01R 13/627

[52] U.S. Cl. ..... 439/352; 439/357

[58] Field of Search ..... 439/350-358, 439/607, 610

[56] References Cited

U.S. PATENT DOCUMENTS

| | | | |
|---|---|---|---|
| 3,760,335 | 9/1973 | Roberts . | |
| 4,548,455 | 10/1985 | Ezure | 439/352 |
| 4,735,583 | 4/1988 | Rudy, Jr. et al. | 439/350 |
| 4,838,808 | 6/1989 | Fujiura | 439/357 |
| 5,158,481 | 10/1992 | Frantz | 439/607 |
| 5,197,895 | 3/1993 | Stupecky | 439/352 |
| 5,197,901 | 3/1993 | Hashiguchi | 439/357 |
| 5,199,897 | 4/1993 | Hashiguchi | 439/357 |

*Primary Examiner*—Gary F. Paumen
*Assistant Examiner*—Hien D. Vu

[57] ABSTRACT

An actuator mechanism (25) comprising: a latch arm holder (26) with an interior (27) adapted to encircle an electrical connector (1), latch arms (28) pivotally mounted on the holder (26), engaging ends (29) of the latch arms (28) adapted to engage with, and to pivot and disengage from, another, mating electrical connector (30), an actuator (33), actuating ends (32) of the latch arms (28) facing toward the actuator (33), the actuator (33) being slidable along the holder (26) and against the actuating ends (32) to pivot the latch arms (28) and the engaging ends (32).

14 Claims, 8 Drawing Sheets

LATCH ACTUATOR FOR A CONNECTOR

FIELD OF THE INVENTION

The invention relates to the field of electrical connectors, and more particularly, to an actuator mechanism and a kit of parts for pivoting latching arms on an electrical connector to unlatch the connector from another, mating connector.

BACKGROUND OF THE INVENTION

An electrical connector disclosed in U.S. Pat. No. 5,158,481 comprises; a terminal support block, contact terminals supported on the block for connection to wires, and shielding for the connector comprising; a mating end on a front shell encircling a mating end of the block, and conductive backshells enveloping the block. It would be desirable to provide latching arms for latching such a connector with another, mating connector.

A connector with latching arms is disclosed in U.S. Pat. No. 5,167,523, wherein each of the latching arms comprises, a pivot pin, an engaging end with a claw shaped latch to engage a prong hook of a complementary connector, a spring arm for resilient spring bias of the engaging end to engage the prong hook, and an actuator end for finger grasping to pivot the engaging end away from the prong hook, opposing the bias of the spring arm. It would be desirable to provide an actuator mechanism for pivoting such latching arms to disengage the latching arms from the other, mating connector. Further, a kit of parts for such an actuator mechanism is desirable.

SUMMARY OF THE INVENTION

A feature of the invention resides in latching arms for connecting an electrical connector to another, mating electrical connector. A further feature of the invention resides in an actuator to pivot the latching arms. The invention fulfills a further desire to provide a kit of parts for an actuator mechanism comprising, latch arms and an actuator.

According to the invention, a kit of parts for an actuator comprises, a latch arm holder with an interior adapted to encircle an electrical connector; latch arms adapted for pivotal movement on the holder; engaging ends of the latch arms adapted to engage with, and to pivot and disengage from, another, mating electrical connector; an actuator; actuating ends of the latch arms adapted to face toward the actuator; and the actuator being adapted to slide along the holder and against the actuating ends to pivot the latch arms and the engaging ends.

DESCRIPTION OF THE DRAWINGS

An embodiment of the invention will now be described, by way of example, with reference to the accompanying drawings, according to which.

DETAILED DESCRIPTION

Figure 1:
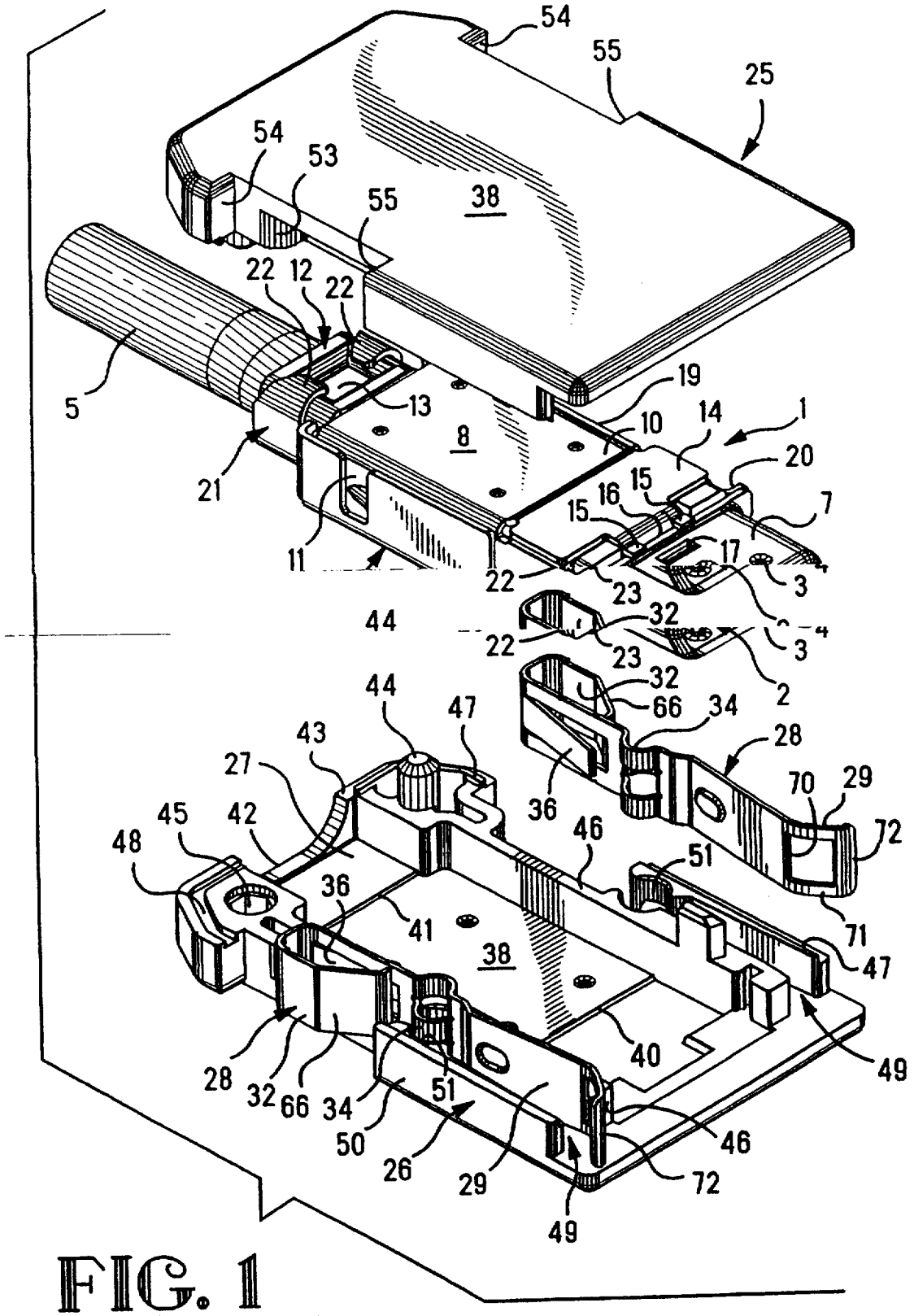
FIG. 1 is a perspective view of a shielded electrical connector and a latching mechanism with parts separated from one another.

With reference to FIG. 1, a shielded plug type connector 1 comprises an insulative plug connector section 2 projecting forwardly for mated connection with a shielded receptacle type, mating connector, not shown. The plug connector section 2 includes a forwardly protruding terminal support block 3 supporting multiple contact terminals 4 having wire terminating portions for connection to insulated wires, not shown, of a shielded multiple wire cable 5. A conductive electrical shielding or shield 6 is provided by a unitary drawn metal front shell 7 and an upper metal backshell 8 and a lower metal backshell 9.

The backshell 8 is of unitary construction stamped and formed from sheet metal. The backshell 8 comprises an upper wall 10 and depending sidewalls 11 providing an inverted channel. At a rear of the backshell 8 is an anchoring member 12 for the lower backshell 9. A recess 13 is formed as a deep depression in the upper wall 10. A plate 14 is offset from the plane of the wall 10 and extends forwardly. A pair of forward extending tabs 15 and a curved, pivot hook 16 project forwardly to engage the front shell 7, with the hook 16 being received in a laterally extending slot 17 in the front shell 7.

The backshell 9 is of unitary construction stamped and formed from sheet metal. The backshell 9 comprises sidewall sections 18, 19 upstanding from a lower wall and defining a channel. Laterally outward turned flanges 20 are on front ends of the sidewall sections 18, 19. From a rear of the backshell 9 projects a cable strain relief member 21 comprising anchoring flanges 22 secured to the anchoring member 12 with the flanges 22 entering the recess 13. Forward of the backshell 9 project tabs not shown, and a pivot hook not shown, similar in construction as described in conjunction with the backshell 8, and with which the backshell 9 is hooked and attached to the front shell 7 to envelop the connector 1. Further details of the backshell 8 and the backshell 9 are discussed in U.S. Pat. No. 5,158,481. Laterally projecting flanges 23 on the backshell 14 engage a laterally projecting flange 24 on the rear of the drawn front shell 7. Further details of the front shell 7 and of the connector 1 are disclosed in U.S. Pat. No. 955,554, filed Oct. 1, 1992 abandoned.

Figure 2:
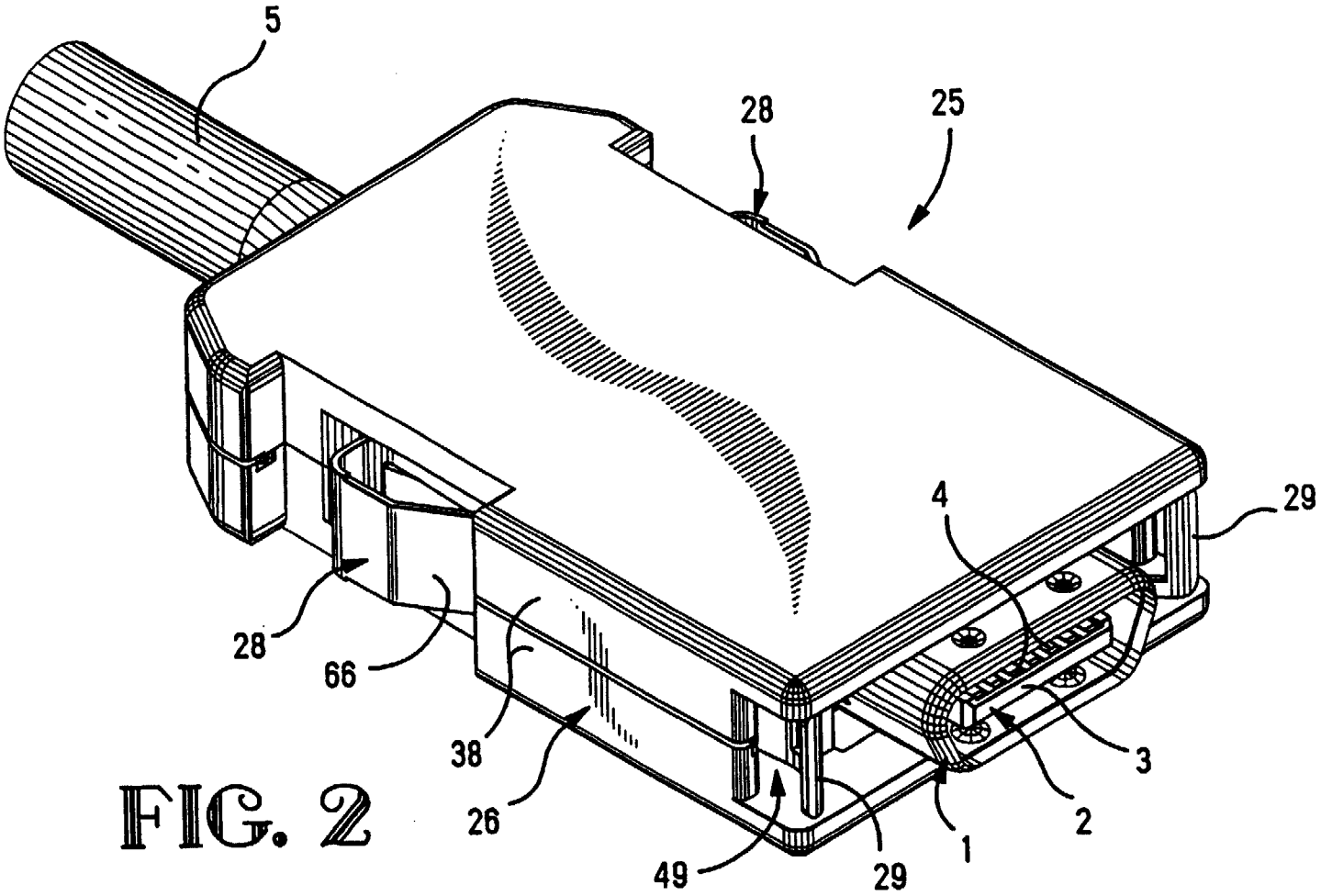
FIG. 2 is a perspective view of the connector and the mechanism shown in FIG. 1.
Figure 3B:
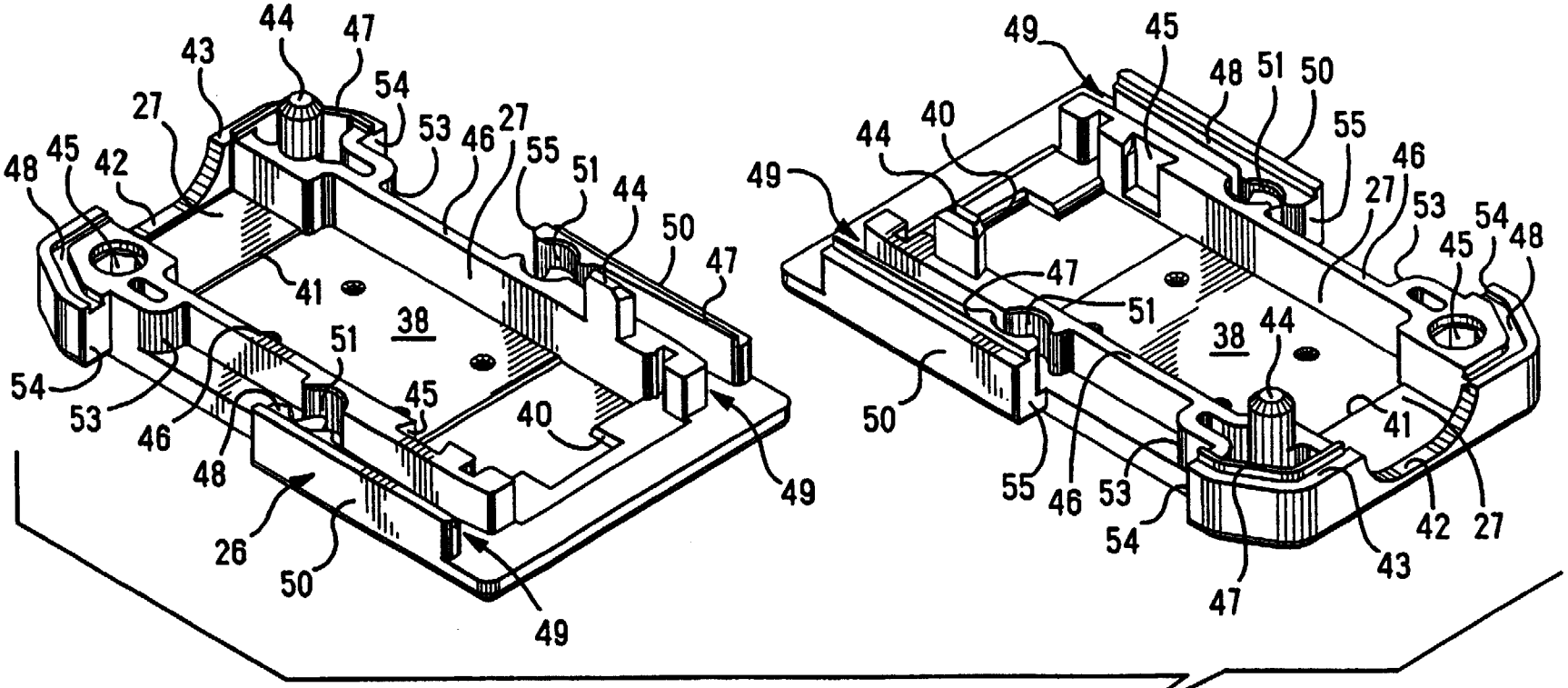
FIG. 3 is a perspective view of holder sections of the mechanism shown in FIG. 1.
Figure 4:
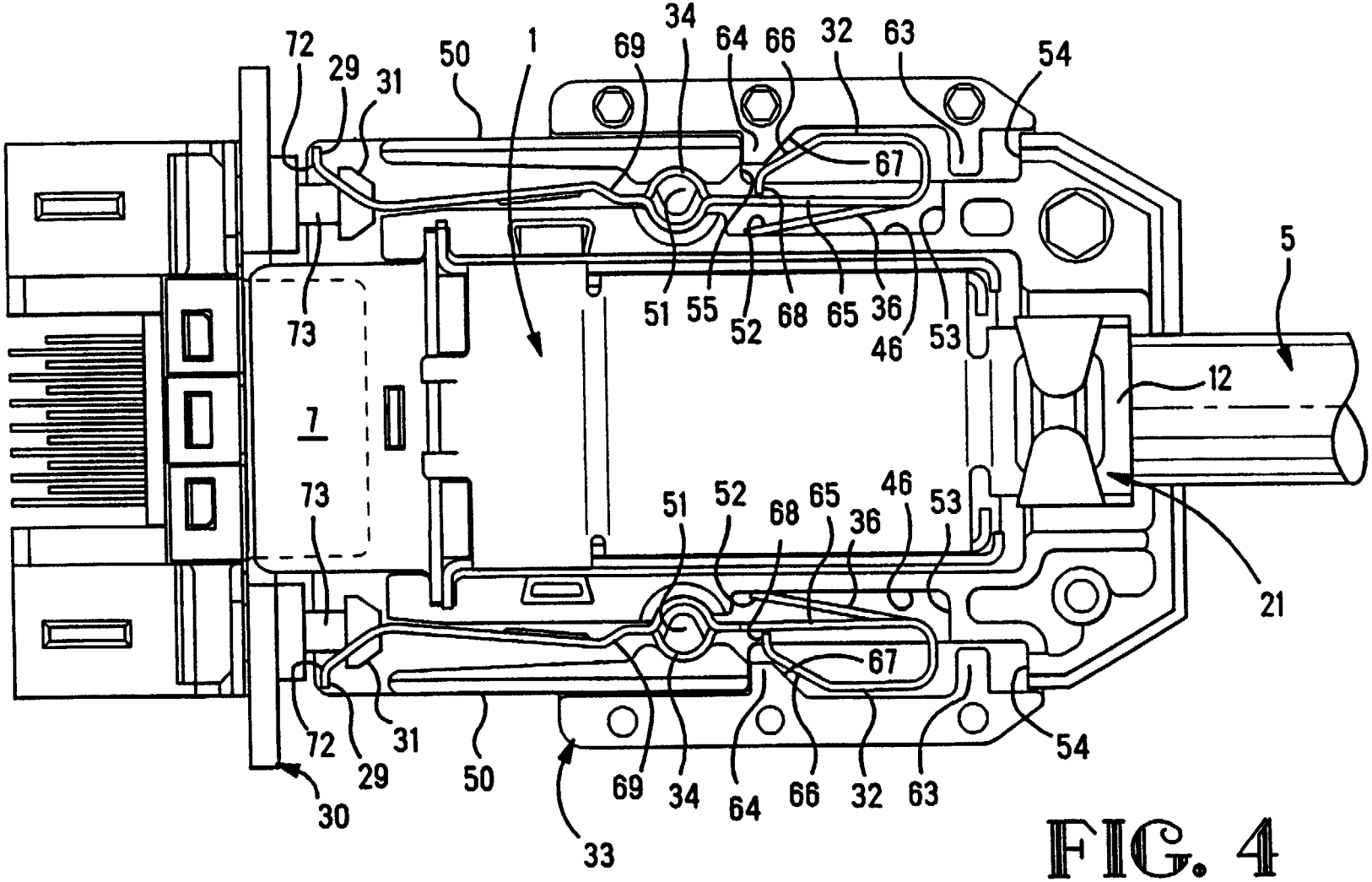
FIG. 4 is a top plan view of the connector and an actuator mechanism connected with another mating electrical connector.
Figure 8:
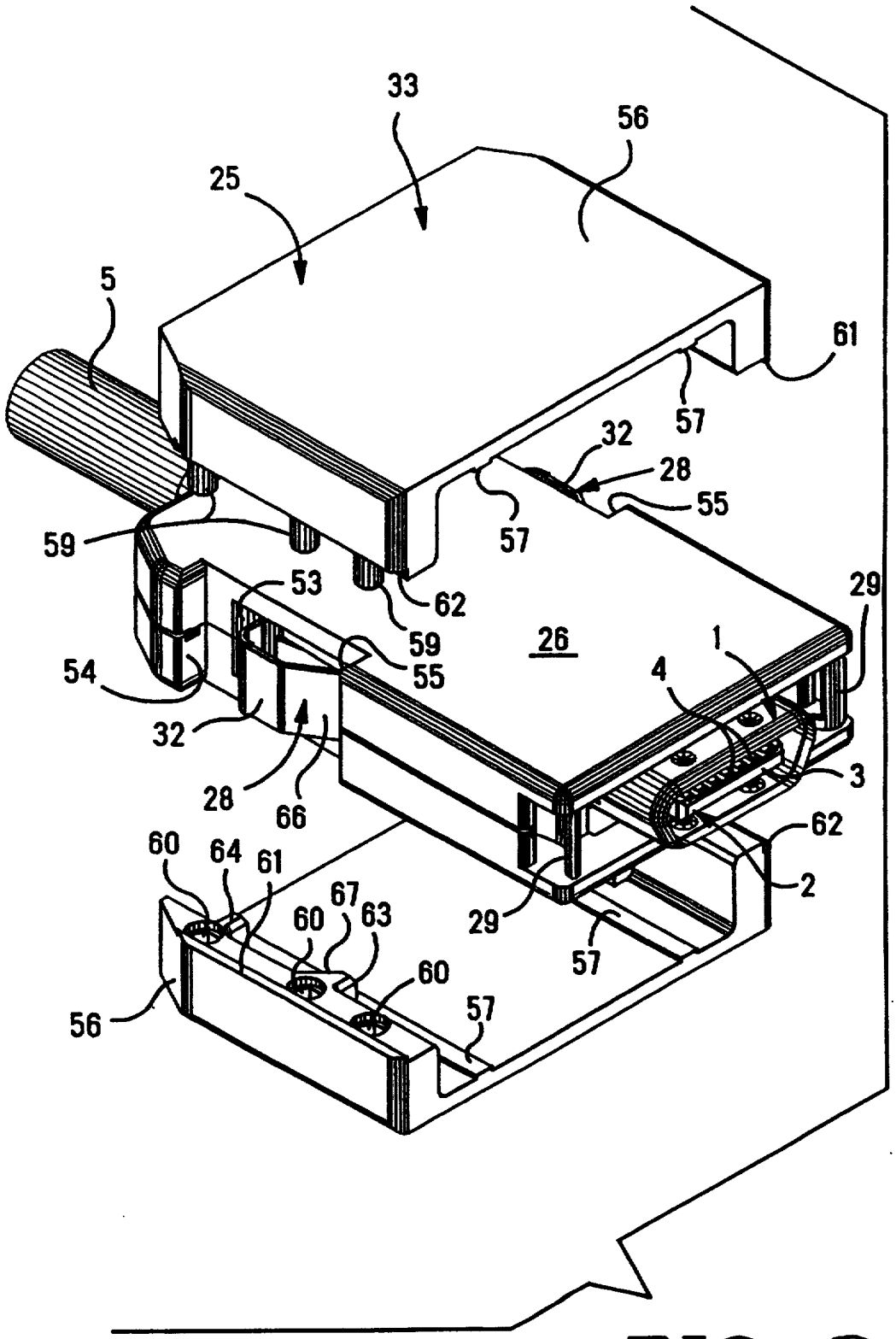
FIG. 8 is a perspective view of the electrical connector shown in FIG. 2, together with an actuator mechanism shown with a pair of actuator sections removed.

With reference to FIGS. 1, 2 and 8, a kit of parts for an actuator mechanism 25 comprises, a latch arm holder 26 with an interior 27 adapted to encircle the electrical connector 1, latch arms 28 adapted for pivotal movement on the holder 26, and engaging ends 29 of the latch arms 28 adapted to engage with another, mating electrical connector 30, FIG. 4, a portion of the mating connector 30 being shown in broken lines entering the connector 1. The mating connector 30 is adapted for mounting on a printed circuit board, and is of the type disclosed, for example, in U.S. Pat. Nos. 4,808,125 and 4,854,890. More particularly, the engaging ends 29 of the latch arms 28 are adapted to engage latching posts 31, meaning posts that are nonrotatable or that may comprise rotatable posts such as jackscrews, that are on the mating connector 30, and that comprise portions of the mating connector 30. The engaging ends 29 of the latch arms 28 are adapted to pivot and disengage from the mating connector 30, FIG. 5. The kit of parts further comprises, actuating ends 32 of the latch arms 28 adapted to face toward a latch arm actuator 33, and the actuator 33 being adapted to slide along the holder 26 and against the actuating ends 32 to pivot the latch arms 28 and the engaging ends 29.

Figure 6:
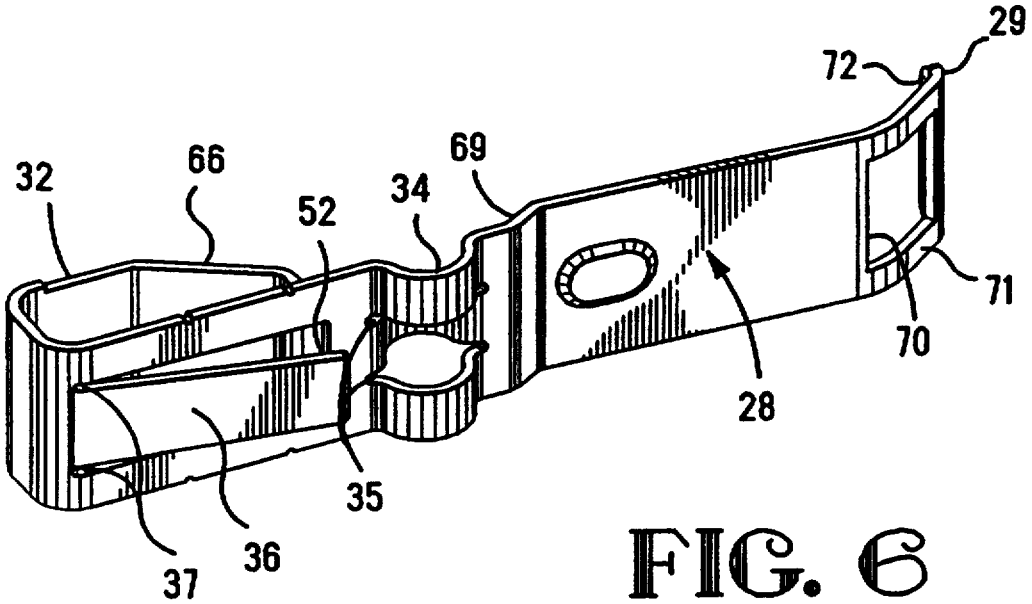
FIG. 6 is a perspective view of one latch arm for engaging a mating electrical connector.

With reference to FIGS. 1, 4 and 6, a description of one of the latch arms 28 will apply to both latch arms 28, the latch arms 28 being duplicates of each other. Each of the latch arms 28 is of unitary construction, stamped and formed from a blank of metal. A circular pivot 34 is formed by oppositely curved strips being bent outwardly from the plane of thickness of the metal blank. The side edges of the strips are defined by adjacent, spaced apart, longitudinal slits 35 extending lengthwise through the blank. The actuating end 32 is formed into a loop, by bending the blank back on itself. The actuating end 32 projects from the pivot 34 in a rearward direction, meaning, in a direction from front to rear relative to the connector 1, FIG. 4. A spring arm 36 extends from each actuating end 32, diagonally convergent toward the electrical connector 1 that is to be encircled by the holder 26. The spring arm 36 is cut out from the metal blank by slits 37 in the blank defining three of four sides of the spring arm 36. The engaging end 29 projects from the pivot 34 in a forward direction, meaning in a direction from rear to front relative to the connector 1, FIG. 4.

With reference to FIGS. 1–4, the holder 26 comprises, duplicate, hermaphroditic first and second holder sections 38 adapted to close together, with one holder section 38 serving as a cover for the other, FIG. 2. Hereafter, a description of one of the duplicate holder sections 38 will apply to both holder sections 38. Structural features on the holder 26 will now be described. Portions of such structural features are on each of the holder sections 38, and combine to form the whole of such structural features when the holder sections 38 are closed together.

Each of the holder sections 38 is fabricated of insulating material of molded construction. The interior 27 of each holder section 38 includes a portion of a connector receiving cavity 39 with a front step 40 and a rear step 41 to interengage with the exterior of the connector 1 and resist movement of the connector 1, forward and rearward. The interior 27 overlies the conductive shield 6 on the connector 7. When the holder sections 38 close together, the connector receiving cavity 39 encloses the connector 1. An opening 42 in a rear wall 43 of the holder 26 provides a rear, cable entry for encircling the cable 5. Interlocking elements comprising, posts 44 and sockets 45, respectively, are within the thicknesses of respective portions of opposite, inner sidewalls 46 on both holder sections 38. The posts and sockets 44, 45 on the same holder section 38 are on opposite sides of the same holder section 38. The posts 44 of one holder section 38 interlock with sockets 45 of the other holder section 38. The posts 44 are of different shapes to prevent undesired insertion of incorrectly shaped posts 44 of one holder section 38 into the sockets 45 of the other holder section 38. A seam between the holder sections 38 is overlapped by a raised tongue 47 on one sidewall 46 of each holder section 38 that interfits with a groove 48 in the opposite sidewall 46 of the other holder section 38.

With reference to FIGS. 1–4, latch arm receiving cavities 49 in the holder 26 receive respective latch arms 28. Portions of the cavities 49 are in both holder sections 38. When the holder sections 38 close together, they enclose the latch arms 28 in the cavities 49. Each of the cavities 49 comprises, the inner sidewall 46 and an outer sidewall 50, portions of which are in both holder sections 38. The outer sidewalls 50 extend straight, in a direction form front to rear. A socket 51 in each cavity 49 comprises rounded sidewall portions recessed in both of the sidewalls 50, 51. Portions of each socket 51 in both holder sections 38 receive portions of a corresponding circular pivot 34 for rotation, FIGS. 1 and 4.

The sidewalls 46, 50 are spaced apart to permit pivotal movement of the latch arms 28 by rotation of the pivots 34 in the sockets 51. With reference to FIG. 4, A tip 52 of each spring arm 36 impinges against an inner side wall 46 of a corresponding cavity 49, biasing the actuating ends 32 of the latch arms 28 outwardly, meaning away from the connector 1 to be held by the holder 26. Openings 53 extend laterally in the outer side walls 50 of the cavities 38 are rearward of respective sockets 51. Portions of the openings 53 are on both holder sections 38. The actuating ends 29 of the latch arms 28 are adapted to project outwardly of the sidewalls 50 and along respective openings 53. The inner sidewalls 46 will be engaged by the actuating ends 32 to provide a stop for limiting pivotal movement of the actuating ends 32 inwardly, meaning toward the connector 1 to be held by the holder 26. Each of the openings 53 is defined between a rear stop surface 54 and a front stop surface 55, portions of which are on both holder sections 38. What has been described is an electrical connector 1 with latch arms 28 and a latch arm holder 26 that confines the connector 1 and separates the latch arms 28 from the connector 1.

Figure 5:
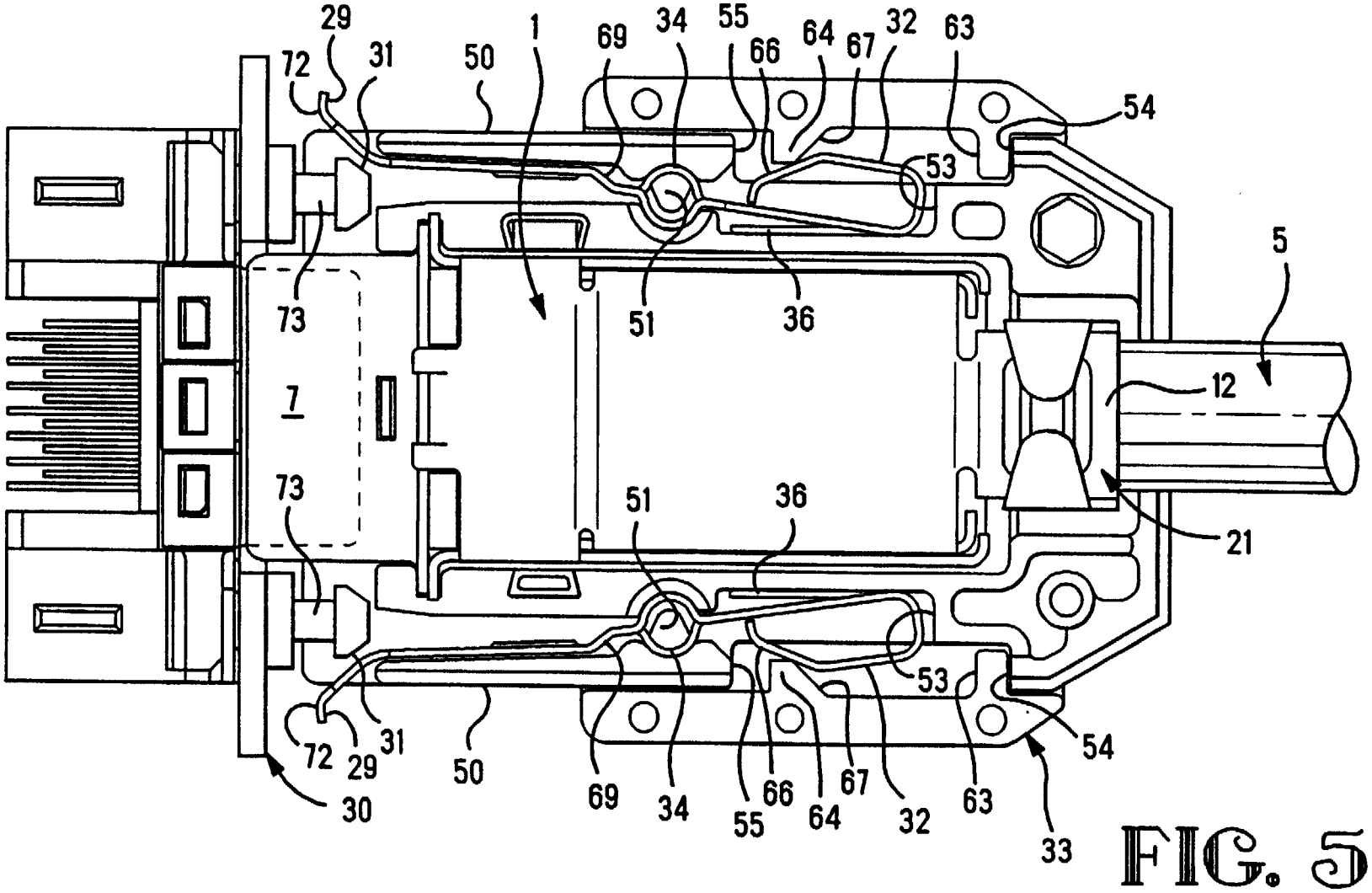
FIG. 5 is a view similar to FIG. 4, illustrating the actuator mechanism released from the mating electrical connector.

With reference to FIGS. 2 and 5, forces applied inwardly against the actuating ends 32 will pivot the actuating ends 32 inwardly toward the connector 1 being enclosed by the holder 26, causing the latch arms 28 to pivot against the bias of the spring arms 36. When the actuating ends 32 are moved pivotally inward toward the connector 1, the spring arms 36 are deflected pivotally and resiliently, with the tips 52 of the spring arms 36 bearing against the inner sidewalls 46 of corresponding cavities 49. The engaging end 29 of each latch arm 28 projects through an open front end of a corresponding cavity 49, and is biased by the spring arm 36 inwardly toward the connector 1 for interlocking engagement with the corresponding jack screw 31. When the actuating end 32 pivots inwardly toward the connector 1, the engaging end 29 is pivoted outwardly to release, and disconnect, from the latching post 31 on the mating connector 30.

Figure 7:
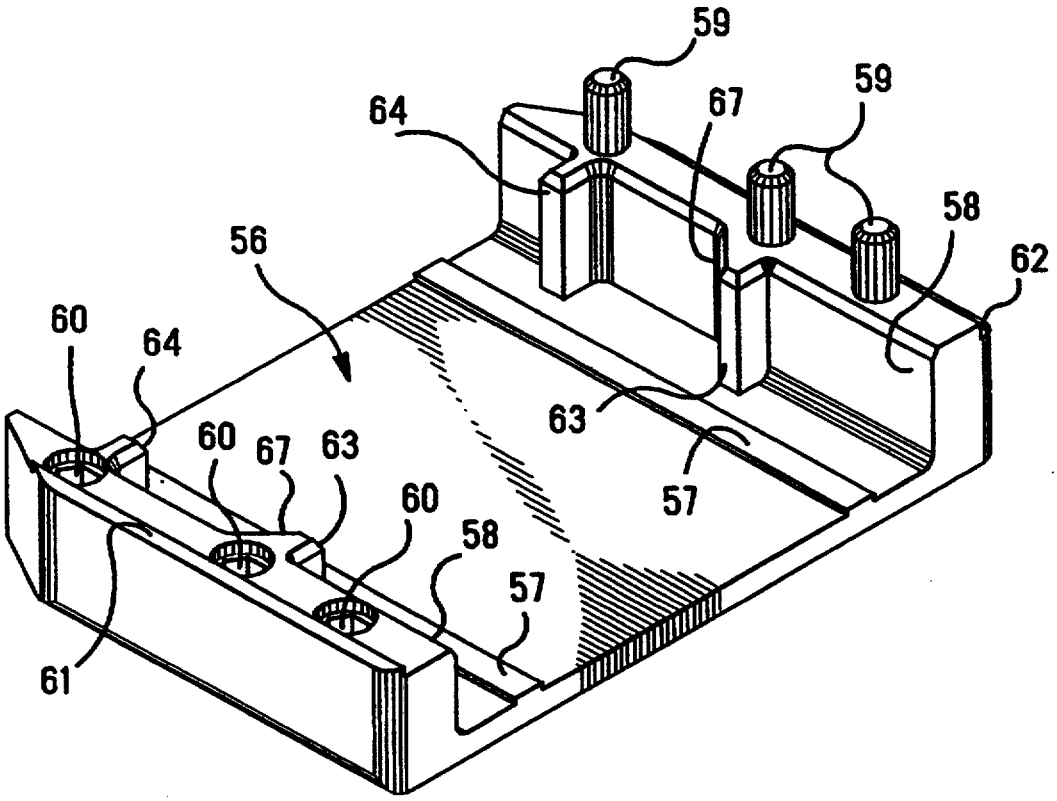
FIG. 7 is perspective view of one of an identical pair of actuator sections.
Figure 9:
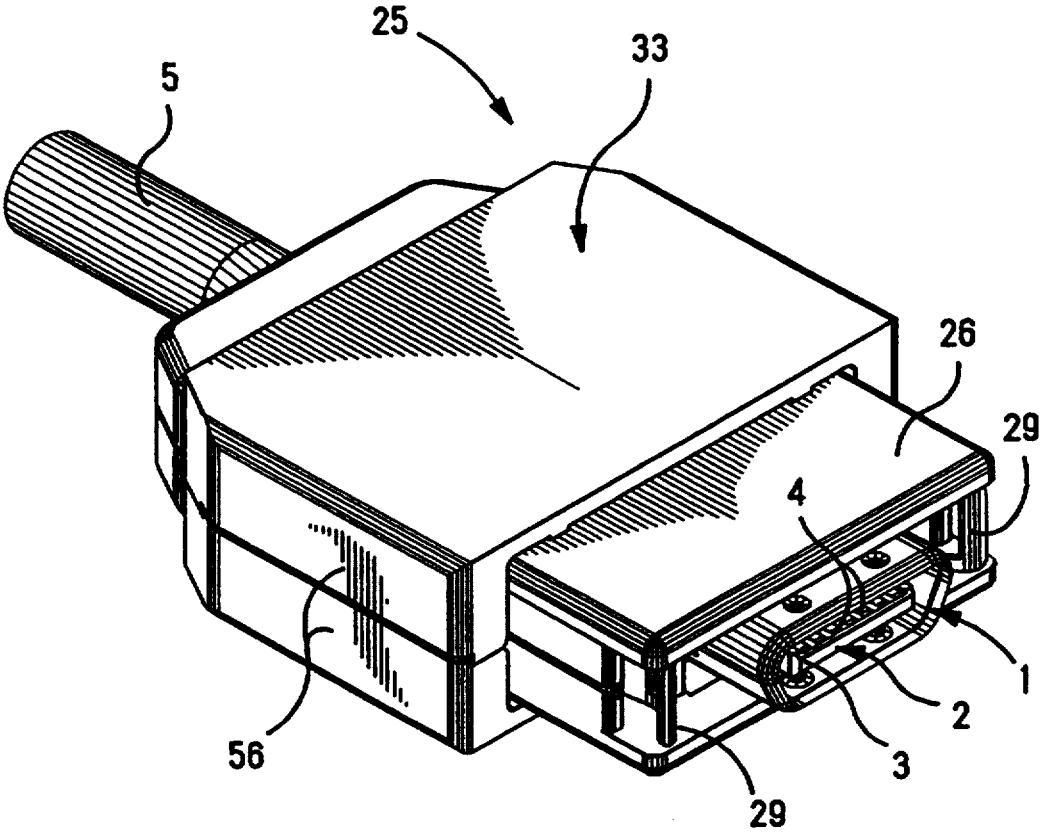
FIG. 9 is a perspective view of the actuator mechanism as shown in FIG. 4, and of the connector as shown in FIG. 2.

With reference to FIGS. 4, 5 and 7, the actuator 33 comprises, duplicate, hermaphroditic first and second actuator sections 56 adapted to close together, with one actuator section serving as a cover for the other, FIGS. 8 and 9. Hereafter, a description of one of the duplicate actuator sections 56 will apply to both actuator sections 56. Structural features on the actuator 33 will now be described. Portions of such structural features are on each of the actuator sections 56, and combine to form the whole of such structural features when the actuator sections 56 are closed together.

With reference to FIGS. 7, 8 and 9, the actuator sections 56 are insulating material of molded construction. Raised rails 57 extend straight, from front to rear, along broad inner surfaces of the actuator sections 56 to slidingly impinge against straight sides on the exterior of the holder 26, FIG. 8. Inner, straight sidewalls 58 of the actuator 33 project from the inner surfaces, and are adapted to slidingly impinge against the straight outer sidewalls 50. Portions of the sidewalls 58 are on both actuator sections 56. Interlocking elements comprising posts 59 and sockets 60, respectively, are within the thickness of respective portions of the sidewalls 58 on both actuator sections 56. The posts and sockets 59, 60 on the same actuator section 56 are on opposite sides 58 of the same actuator section 56. There are three spaced apart posts 59 of one actuator section 56 that interlock with correspondingly spaced apart three sockets 60 of the other actuator section 56. The three posts 59 are spaced apart unequal distances to prevent undesired insertion of incorrectly spaced posts 59 of one actuator section 56 into the sockets 60 of the other actuator section 56. The actuator sections are constructed for interlocked connection with each other. Each of the actuator sections comprises raised fillets in the sockets. The fillets are spaced from open entrance ends of the sockets. The posts are adapted to be moved along the entrance ends without engaging the fillets. This allows alignment of the posts within the sockets prior to interlocking the holder sections together. The posts are adapted to be moved further along the sockets to engage the posts and the fillets with an interference fit. At least one of the sockets is defined by a cylindrical side wall. In the embodiment shown, each of the sockets is defined by a cylindrical side wall. Each post has a cylindrical side wall that fits slidably along a corresponding socket. A tip of the post is tapered for ease of entry into the entrance end of the corresponding socket.

Assembly of the actuator sections will now be described. The tips of the posts are inserted into the entrance ends of the sockets. The posts are moved along the sockets until sides of the posts first impinge against the fillets in the sockets. There the posts remain restrained from further movement along the sockets, due to the posts engaging the posts against the fillets. Alignment of the posts and the sockets, and the positions of the latch arms relative to the actuator sections can be inspected for correctness. The actuator sections are moved toward each other, causing continued, further movement of the posts along the sockets. Further movement of the posts along the sockets will urge the posts alongside the fillets, into interference fit with the fillets in the sockets. The interference fit of the posts and the fillets interlock and connect the actuator sections together.

A raised tongue 61 on one sidewall 58 of each actuator section 56 interfits with a groove 62 in the opposite sidewall 58 of the other actuator section 56 to close a seam between the closed together actuator sections 56. Spaced apart, inward stop fingers 63, 64 are on each sidewall 58. Portions of the stop fingers 63, 64 are on both actuator sections 56. When the actuator sections 56 close together to encircle the holder 26, they enclose the actuating ends 32 of the latch arms 28.

The two stop fingers 63, 64 on the same sidewall 58 will now be described. The two stop fingers 63, 64 project into a corresponding opening 53 in the holder 26 between the stop surfaces 54, 55. The two stop fingers 63, 64 receive one of the actuating ends 32 of the latch arms 28 therebetween. The two stop fingers 63, 64 project on opposite sides, front and rear, of the actuating section 32 of a corresponding one of the latch arms 28. The two stop fingers 63, 64 are spaced apart a distance less than the distance separating the stop surfaces 54, 55 on the same side of the holder 26. The two stop fingers 63, 64 are displaced back and forth between the stop surfaces 54, 55 upon sliding movement of the actuator 33, back and forth along the holder 26.

With reference to FIG. 5, the actuator 33 is grasped and pulled rearwardly when it is desired to release the latch arms 28 from the mating connector 30 and to disconnect, or unmate, the connector 1 from the mating connector 30. The actuator 33 moves rearwardly along the holder 26, forcing the forward stop fingers 64 toward and against the actuating ends 32 of the latch arms 28, applying inward force on the actuating ends 32, and causing the engaging ends 29 to pivot and release from the latching posts 31 on the mating connector 30.

The rear stop fingers 63 on the actuator 33 engage the rear stop surfaces 54 on the holder 26 to limit sliding movement of the actuator 33 rearwardly. This feature is advantageous to prevent removal of the actuator 33 when it is grasped and pulled rearwardly, both to bias the engaging ends 29 of the latch arms 28 outwardly to release the latch arms 28 from the mating connector 30, and to disconnect or unmate the connector 1 from the mating connector 30. One motion of the actuator 33 in a rearward direction, both will release the latch arms 28, and disconnect the connector 1 from the mating connector 30.

The front stop fingers 64 engage the front stop surfaces 55, FIG. 4, to limit sliding movement of the actuator 33 forwardly, for example, when the actuator 33 is grasped and moved forwardly to impel the connector 1 toward the mating connector 30 for mating connection of the connector 1 with the connector 30. With reference to FIGS. 1, 4 and 6, the latch arms 28 will now be described further. A straight stem 65 on the actuating end 32 of each latch arm 28 is joined to the pivot 34. A straight, forwardly inclined surface 66 on the actuating end 32 faces diagonally outward relative to the connector 1. For this embodiment, for example, the inclined surface 66 is on the loop.

With reference to FIG. 4, forwardly inclined surfaces 67 on the forward stop fingers 64 of the actuator 33 are diagonally inclined, and face toward the forwardly inclined surfaces 66 on the actuating ends 32. When the actuator 33 undergoes rearward movement along the holder 26, FIG. 5, the forwardly inclined, diverging surfaces 67 on the stop fingers 64 impinge against the forwardly inclined surfaces 66 on the actuating ends 32 of the latch arms 28, pivoting the latch arms 28 inwardly against the bias of the spring arms 36. When the actuator 33 is released from grasp, the spring arms 36 bias outwardly the actuating ends 32 of the latch arms 28. The forwardly inclined surfaces 66 and 67 are biased against one another, enabling the spring arms 36 to bias the actuator forwardly to permit outward movement of the actuating ends 32.

A tip 68 of the loop faces the remainder of the actuating end 32 to abut the same. This feature prevents permanent flattened distortion of the loop after being engaged by the actuator 33. When the actuating ends 32 are moved pivotally inwardly toward the connector 1, the spring arms 36 are deflected pivotally and resiliently, with the 52 tips of the spring arms 36 bearing against the inner side walls 46 of corresponding cavities 49. The tips 52 of the spring arms 36 are closer to the pivots 34 than are the inclined surfaces 66, such that pivotal deflection of the spring arms 36 are proportionately larger than the pivotal movement of the inclined surfaces 66 toward the connector 1. Thus, a relatively small movement of the actuating ends 29 develops a relatively large spring bias, tending to return the movement of the actuating ends 29. The spring arms 36 are on the actuating ends 29 between the actuating ends 29 and the inner sidewall 46 against which register the tips 52 of the spring arms 36. Thus, forces applied inwardly on the actuating ends 32, exert direct compression on both the actuating ends 32 and the spring arms 36, tending to return the spring arms 36 into the thicknesses of the actuating ends 32.

When the actuator 33 is released from being grasped, the diagonal surfaces 67 tend to slide forwardly, and off the inclined surfaces 66 of the actuating ends 32, providing no resistance to the spring arms 36 biasing the actuating ends 29 outwardly. The actuator 33, when released, will move forwardly with respect to the holder 26 to a position as shown in FIG. 4.

With reference to FIGS. 1, 4 and 6, further details of each of the latch arms 28 will now be described. The engaging end 29 projects from the pivot 34 in a forward direction, meaning, a direction from rear to front. A bent offset 69, in the engaging end 29 adjacent to the pivot 34, projects the remainder of the engaging end 29 convergently toward the connector 1 that is to be received by the holder 26. A tip of the engaging end 29 comprises, a window 70 surrounded by an encircling, continuous frame 71, the frame 71 being flared outwardly at a leading end 72 to provide a flared funnel entry, the frame 71 being inclined outwardly, and the window 70 being inclined outwardly to face diagonally with respect to a forward direction.

The tips 52 of the spring arms 36 are adapted to continuously engage the inner sidewalls 46, biasing the engaging ends 29 inwardly to engage the mating connector 30, and more particularly, the latching posts 31, FIGS. 4 and 5. The actuator 33 is grasped to move the connector 9 forwardly and toward the mating connector 30 for mating engagement. During movement of the connector 1 forwardly, the actuator 33 will have moved forwardly with respect to the holder 26, to a position as shown in FIG. 4. The leading ends 72 of the engaging ends 29 will engage and slide along the heads of the latching posts 31. Because the leading ends 72 are inclined, they will bias the engaging ends 29 outwardly, against the bias of the spring arms 36. The latching posts 31 have wide, enlarged heads at ends of narrow shafts 73. The frames 71 will then pivot outwardly. The openings of the windows 70 will be pivoted outwardly to face further in a forward direction. The openings of the windows 70 will then appear to be larger when viewed from a forward direction. The enlarged heads of the latching posts 31 will then be received in the windows 70 when the windows 70 appear to be larger.

Once the connector 1 is impelled forwardly into mating engagement with the mating connector 30, the windows 70 will have moved forwardly to enter the enlarged heads of the latching posts 31 in the windows 70, and the leading ends 72 will have moved past the enlarged heads. The spring arms 36 then bias the engaging ends 29 inwardly, moving the leading ends 72 of the frame 71 inwardly toward the slender shafts 73 of the latching posts 31. The frame 71 of the window 70 will then be captive behind the heads of the latching posts 31 to resist movement of the connector 1 rearwardly from the mating connector 30, FIG. 4. Because the frames 71 are inclined so as to intersect the axes of the shafts 73, exertion of a pulling force on the cable 5 will have a tendency to pull on the frames 71, and will have a tendency to straighten the frames 71, causing the frames 71 to pull and impinge even more tightly against the enlarged heads of the latching posts 31. Because the frames 71 are circumferentially continuous, they resist being bent and deformed when twisting forces are applied to them while they are being held against the latching posts 31. The frames remain connected to the latching posts despite a bending force being applied to them in response to a force being applied to the connector 1 or to the cable 5. The actuator 33 can be released from grasp once the connector 1 is in mating engagement with the mating connector 30.

Figure 10:
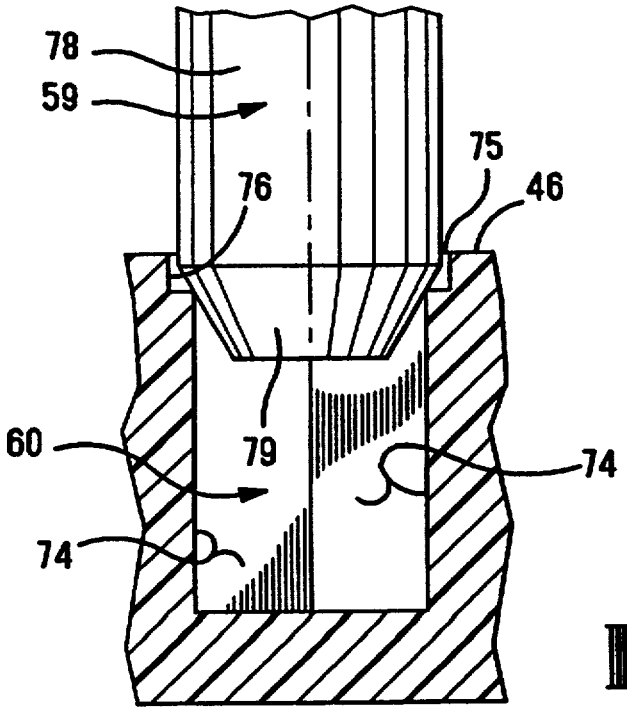
FIG. 10 is an enlarged fragmentary view in section of interlocking elements on the actuator sections as shown in FIG. 8.

According to an aspect of the invention, the actuator 33 is constructed for self locking assembly of the actuator sections 56. The actuator sections 56 are constructed for interlocked connection with each other. With reference to FIGS. 7 and 10, each of the actuator sections 56 further comprises raised fillets 74 in the sockets 60. The fillets 74 are lengthwise along the sockets 60, and are shorter than the lengths of the sockets 60. The fillets 74 are spaced from open entrance ends 75 of the sockets 60. The posts 59 are adapted to be moved along the entrance ends 75 without engaging the fillets 74. This allows alignment of the posts 59 within the sockets 60 prior to interlocking together the actuator sections 56. The posts 59 are adapted to be moved further along the sockets 60 to engage the posts 44 and the fillets 74 with an interference fit.

With reference to FIG. 10, each of the sockets 60, FIG. 10, is defined by a cylindrical, side wall 76. At least one said fillet 74 projects along the cylindrical side wall 76. In the embodiment disclosed in FIG. 10, multiple fillets 74 are side by side in the corresponding socket 60 defined by the cylindrical side wall 76. Each post 59 has a cylindrical side 78 that fits slidably along the corresponding socket 60 with the cylindrical side wall 76. A tip 79 of the cylindrical post 59 is tapered for ease of entry into the entrance end 75 of the corresponding socket 60.

Assembly of the actuator sections 56 will now be described. The tips 79 of the posts 59 are inserted into the entrance ends 75 of the sockets 60. The posts 59 are moved along the sockets 60 until sides 78 of the posts 59 first impinge against the fillets 74 in the sockets 60. There the posts 59 remain restrained from further movement along the sockets 60, due to the posts 594 engaging the fillets 74. The actuator sections 56 are assembled part way. Alignment of the posts 59 and the sockets 60, and the positions of the latch arms 28 relative to the actuator sections 56, can be inspected for correctness. To complete the assembly of the actuator sections 56, they are urged toward each other, causing continued, further movement of the posts 59 along the sockets 60. A bench press, not shown, may be necessary to exert the required force to urge together the actuator sections 56. Further movement of the posts 59 along the sockets 60 will urge the posts 59 alongside the fillets 74, and into interference fit with the fillets 74 in the sockets 60. The interference fit of the posts 59 and the fillets 74 in the sockets 60 interlock and connect together the actuator sections 56.

A feature of the invention resides in latch arms for connecting an electrical connector to another, mating electrical connector. A further feature of the invention resides in an actuator to pivot the latching arms. The invention fulfills a further desire to provide a kit of parts for an actuator mechanism comprising, latch arms and an actuator.

According to an advantage of the invention, an encircling frame around an open window comprises a strong latch mechanism that resists deformation better than does a claw shaped latch.

According to another advantage of the invention, an actuator mechanism disconnects latch arms from a mating electrical connector by sliding movement along a holder of the latches that is associated with an electrical connector for mating connection with the mating connector.

According to another advantage of the invention, posts and sockets on actuator sections interlock by fillets in the sockets forming an interference fit with the posts in the sockets.

Another advantage of the invention resides in an electrical connector with latch arms and a latch arm holder that confines the connector and separates the latch arms from the connector.

Another advantage of the invention resides in an electrical connector with latch arms having open windows encircled by frames, and leading edges of the frames providing flared funnel entries for the windows.

We claim:

1. A kit of parts for an actuator mechanism comprising: a latch arm holder with an interior adapted to encircle an electrical connector; latch arms adapted for pivotal movement in the holder; engaging ends of the latch arms adapted to engage with, and to pivot and disengage from, another mating electrical connector; an actuator having identical actuator sections; actuating ends of the latch arms adapted to face toward the actuator; the actuator being adapted to slide along the holder and against the actuating ends to pivot the latch arms and the engaging ends; interlocking posts and sockets on the actuator sections; fillets in the sockets recessed from entrance ends of the sockets; and the posts being adapted to be inserted in entrance ends of the sockets, and thereafter alongside the fillets in the sockets and in interference fit with the fillets in the sockets.

2. An actuator mechanism comprising: a latch arm holder with an interior adapted to encircle an electrical connector; latch arms pivotally mounted in the holder; engaging ends of the latch arms adapted to engage with, and to pivot and disengage from, another mating electrical connector; an actuator having identical actuator sections; actuating ends of the latch arms facing toward the actuator; the actuator being slidable along the holder and against the actuating ends to pivot the latch arms and the engaging ends; interlocking posts and sockets on the actuator sections; fillets in the sockets recessed from entrance ends of the sockets; and the posts being adapted to be inserted in entrance ends of the sockets, and thereafter alongside the fillets in the sockets and in interference fit with the fillets in the sockets.

3. An electrical connector, comprising: a connector section having a terminal support block; electrical terminals on the support block; a latch arm holder with an interior adapted to encircle the electrical connector; latch arms pivotally mounted in the holder; engaging ends of the latch arms adapted to engage with, and to pivot and disengage from, another mating electrical connector; the latch arms having windows encircled by a frame; a leading edge of each of said frames being flared to provide a funnel entry; the windows being adapted to receive latching posts of another mating connector; identical actuator sections; interlocking posts and sockets on the actuator sections; fillets in the sockets recessed from entrance ends of the sockets; and the posts being adapted to be inserted in entrance ends of the sockets, and thereafter alongside the fillets in the sockets and in interference fit with the fillets in the sockets.

4. An actuator mechanism comprising: a latch arm holder with an interior adapted to encircle an electrical connector; latch arms pivotally mounted in the holder; engaging ends of the latch arms adapted to engage with, and to pivot and disengage from, another mating electrical connector; actuating ends of the latch arms projecting outwardly from exterior sections of the holder; and an actuator having two actuator sections positioned around the holder and being slidable rearwardly over the exterior sections of the holder and against the actuating ends to pivot the latch arms and to disengage the engaging ends from said another mating electrical connector.

5. An actuator mechanism as recited in claim 4, comprising: stop fingers on the actuator receiving therebetween the actuating end of one of the latch arms, and spaced apart stop surfaces on the holder, the stop fingers being displaced between the stop surfaces upon movement of the actuator along the holder.

6. An actuator mechanism as recited in claim 4, comprising: spring arms on the latching arms biasing the actuating ends outwardly against surfaces on the actuator to bias the actuator forwardly.

7. An actuator mechanism as recited in claim 4, comprising: the actuator comprising, actuator sections; interlocking posts and sockets on the actuator sections; fillets in the sockets recessed from entrance ends of the sockets; and the posts being adapted to be inserted in entrance ends of the sockets, and thereafter alongside the fillets in the sockets and in interference fit with the fillets in the sockets.

8. An electrical connector, comprising: a connector section having a terminal support block, electrical terminals on the support block, a latch arm holder with interior sections adapted to encircle the connector section, latch arms pivotally mounted in the holder, engaging ends of the latch arms adapted to engage with, and to pivot and disengage from another mating electrical connector, actuating ends of the latch arms projecting outwardly from exterior sections of the holder, and an actuator having two actuator sections positioned around the holder and being slidable rearwardly along the exterior sections of the holder and against the actuating ends to pivot the latch arms and to disengage the engaging ends from said another mating electrical connector.

9. An electrical connector as recited in claim 8, comprising: stop fingers on the actuator receiving therebetween the actuating end of one of the latch arms, and spaced apart stop surfaces on the holder, the stop fingers being displaced between the stop surfaces upon movement of the actuator along the holder.

10. An electrical connector as recited in claim 8, comprising: spring arms on the latching arms biasing the actuating ends outwardly against surfaces on the actuator to bias the actuator forwardly.

11. An actuator mechanism in combination with an electrical connector, comprising: an electrical connector for connection with, and disconnection from, another mating electrical connector; a latch arm holder with an interior adapted to encircle the electrical connector; latch arms pivotally mounted in the holder; engaging ends of the latch arms adapted to engage with, and to pivot and disengage from said mating electrical connector; an actuator having two actuator sections positioned around the holder; actuating ends of the latch arms projecting outwardly from exterior sections of the holder; and the actuator being slidable over the exterior sections of the holder and against the actuating ends to pivot the latch arms and to disengage the engaging ends from said another mating electrical connector.

12. An actuator mechanism in combination with an electrical connector as recited in claim 11, comprising: stop fingers on the actuator receiving therebetween the actuating end of one of the latch arms, and spaced apart stop surfaces on the holder, the stop fingers being displaced between the stop surfaces upon movement of the actuator along the holder.

13. An actuator mechanism in combination with an electrical connector as recited in claim 11, comprising: spring arms on the latching arms biasing the actuating ends outwardly against surfaces on the actuator to bias the actuator forwardly.

14. An actuator mechanism as recited in claim 11, comprising: the actuator comprising, actuator sections; interlocking posts and sockets on the actuator sections; fillets in the sockets recessed from entrance ends of the sockets; and the posts being adapted to be inserted in entrance ends of the sockets, and thereafter alongside the fillets in the sockets and in interference fit with the fillets in the sockets.

* * * * *